US009174086B1

(12) United States Patent
Griggs et al.

(10) Patent No.: US 9,174,086 B1
(45) Date of Patent: Nov. 3, 2015

(54) APPARATUS AND METHOD FOR DELIVERY OF ASSISTIVE FORCE TO USER MOVED WEIGHTS

(71) Applicants: Jason Griggs, Limerick, PA (US); Matthew Cubbler, Royersford, PA (US); Glenn R. Siegele, Pottstown, PA (US); Leonard A. Dube, Exton, PA (US)

(72) Inventors: Jason Griggs, Limerick, PA (US); Matthew Cubbler, Royersford, PA (US); Glenn R. Siegele, Pottstown, PA (US); Leonard A. Dube, Exton, PA (US)

(73) Assignee: Omegamax Holding Company, LLC, Royersford, PA (US)

( * ) Notice: Subject to any disclaimer, the term of this patent is extended or adjusted under 35 U.S.C. 154(b) by 0 days.

(21) Appl. No.: 14/537,976

(22) Filed: Nov. 11, 2014

Related U.S. Application Data

(63) Continuation of application No. 13/840,150, filed on Mar. 15, 2013, now Pat. No. 8,900,097.

(51) Int. Cl.

| | |
|---|---|
| ***A63B 24/00*** | (2006.01) |
| *A63B 21/005* | (2006.01) |
| *A63B 21/00* | (2006.01) |

(52) U.S. Cl.
CPC ..... *A63B 24/0087* (2013.01); *A63B 21/0058* (2013.01); *A63B 21/00178* (2013.01)

(58) Field of Classification Search
CPC ..... A63B 24/00; A63B 24/0087; A63B 21/0058; A63B 21/00178
See application file for complete search history.

(56) References Cited

U.S. PATENT DOCUMENTS

| | | | |
|---|---|---|---|
| 4,765,611 | A | 8/1988 | MacMillan |
| 4,988,095 | A | 1/1991 | Ferrari |
| 5,058,888 | A | 10/1991 | Walker et al. |
| D325,610 | S | 4/1992 | Walker et al. |
| 5,147,263 | A | 9/1992 | Mueller |
| 5,209,715 | A | 5/1993 | Walker et al. |
| 5,230,672 | A | 7/1993 | Brown et al. |
| 5,254,885 | A | 10/1993 | Ando |
| 5,476,428 | A | 12/1995 | Potash et al. |
| 5,653,666 | A | 8/1997 | Pantoleon |
| 6,375,598 | B1 | 4/2002 | Frame et al. |
| 6,447,431 | B1 | 9/2002 | Milburn et al. |
| 6,558,299 | B1 | 5/2003 | Slattery |
| 6,774,885 | B1 | 8/2004 | Even-Zohar |
| 7,871,355 | B2 | 1/2011 | Yeh |
| 7,963,886 | B1 | 6/2011 | Schwinn et al. |
| 7,998,038 | B2 | 8/2011 | Keiser |

(Continued)

OTHER PUBLICATIONS

The Barwis Method® MaxOut Tower User Manual from www.maxoutcorp.com, 21 pages, copyright 2013.

*Primary Examiner* — Glenn Richman
(74) *Attorney, Agent, or Firm* — Panitch Schwarze Belisario & Nadel LLP

(57) ABSTRACT

An apparatus providing an assist force to user moved weight of an existing un-motorized exercise or rehab machine or stand includes an assembly with operably connected motor and reel, a human-machine interface (HMI) that accepts input of variable parameters for assist control including entry of at least a user selected assist force and number of movement repetitions, a motor drive and a main digital controller connected with at least the motor, motor drive and HMI. The controller is programmed to provide a user selected non-zero assist force essentially only during parts of an exercise and a nominal static or drag force at other times. A cable has a first end securable to the reel and a second end configured to be coupled directly or indirectly with the weight to be moved by the user. The apparatus can be supplied in kit form.

23 Claims, 10 Drawing Sheets

(56) References Cited

U.S. PATENT DOCUMENTS

| | | | | |
|---|---|---|---|---|
| 8,727,946 | B2 | 5/2014 | Greenhill et al. | |
| 8,900,097 | B1 | 12/2014 | Griggs et al. | |
| 2005/0233871 | A1* | 10/2005 | Anders et al. | 482/93 |
| 2006/0094571 | A1* | 5/2006 | Polidi | 482/94 |
| 2008/0176713 | A1* | 7/2008 | Olivera Brizzio et al. | 482/8 |
| 2011/0165995 | A1 | 7/2011 | Paulus et al. | |
| 2011/0165996 | A1 | 7/2011 | Paulus et al. | |
| 2011/0165997 | A1 | 7/2011 | Reich et al. | |
| 2011/0172058 | A1 | 7/2011 | Deaconu et al. | |
| 2011/0195819 | A1 | 8/2011 | Shaw et al. | |
| 2012/0190502 | A1 | 7/2012 | Paulus et al. | |

* cited by examiner

APPARATUS AND METHOD FOR DELIVERY OF ASSISTIVE FORCE TO USER MOVED WEIGHTS

CROSS-REFERENCE TO RELATED APPLICATION

This application is a continuation of and claims priority to U.S. patent application Ser. No. 13/840,150 filed Mar. 15, 2013.

BACKGROUND OF THE INVENTION

The use of motorized exercise or rehabilitation equipment to generate resistive loads for a user and obviate the need for weights are well known. While some motorized resistive systems can be operated to vary the resistive load during certain portions of an exercise cycle and thereby effectively provide an equivalent of assistance, there are some experts who believe that the use of actual weights in training or rehabilitation, with assistance for portions of the exercise, achieves a superior result.

Apparatus to generate assistive loads for a user moving a primary load of weight(s) for exercise or rehabilitation are much less common due to the more numerous and different problems encountered from mounting to control when compared to resistive force systems. U.S. Pat. No. 4,765,611 describes an early hydro-mechanical assistive system that employs counter weights to reduce the primary weight load sustained by a user. All known motorized assistive force apparatus have employed similar counter weight stacks, mounted in their own frames, making such devices quite bulky and heavy. These devise operate by supporting an counter weight stack until assistance is needed and then suddenly removing the support of all or a portion of the stack by a motor and then returning the support to the entire stack at the appropriate time in the exercise cycle. Such systems use common motors that are operated at full torque output when powered and typically controlled for "bang-bang" on/off operation by the use of position switches or proximity detectors.

BRIEF SUMMARY OF THE INVENTION

In one aspect the invention is an assist apparatus for delivering an assist force to user moved weight of an exercise or rehabilitation station comprising: an assist assembly including a motor and a reel operably connected with the motor so as to be rotated by the motor; a flexible assist member having first and second opposing ends, the first end being configured to be secured to the reel so as to permit the member to be wound onto and from the reel by operation of the motor and the second end being configured to be coupled directly or indirectly with the user moved weight; a human-machine interface configured to receive human input of variable parameters for assistance control including entry of at least a user selected non-zero assist force; and a main digital controller operably connected with at least the assist assembly and the human-machine interface, the main digital controller being preprogrammed to convert the user selected non-zero assist force into control signals suitable to operate the motor to provide the user selected non-zero assist force through the flexible assist member during each concentric movement portion of an exercise set having repeated consecutive concentric and eccentric movement portions.

In yet another aspect, the invention is a method of retrofitting an existing, motor-less exercise or rehabilitation station comprising the steps of: collecting together separate components of the assist apparatus of claim 1 as a kit; and supplying the components in the kit to be mounted to a frame of the existing motor-less exercise or rehabilitation station.

In yet another aspect, the invention is a method of retrofitting an existing motor-less exercise or rehabilitation station with the assist apparatus of claim 1 comprising the steps of: fixedly mounting the assist assembly of the assist apparatus on an existing frame of the existing station; fixedly securing the human-machine interface and the main digital computer of the assist apparatus elsewhere on the station; and operably connecting the second end of the flexible assist member with the a user moved primary load interface of the station.

In yet another aspect, the invention is a method of operating the assist apparatus of claim 1 comprising the steps of: initially securing the second end of the flexible assist member with a user moved primary load interface of the station; thereafter generating a user selected non-zero assist force with the assist assembly and supplying that assist force to the primarily load interface with the flexible assist member at least during concentric movement portions of the exercise set; and generating the non-zero static force less than the user selected assist force with the assist assembly and supplying the static force to the primary load interface with the flexible assist member at least during some eccentric movement portions of the exercise set.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

DETAILED DESCRIPTION OF THE INVENTION

Figure 1:
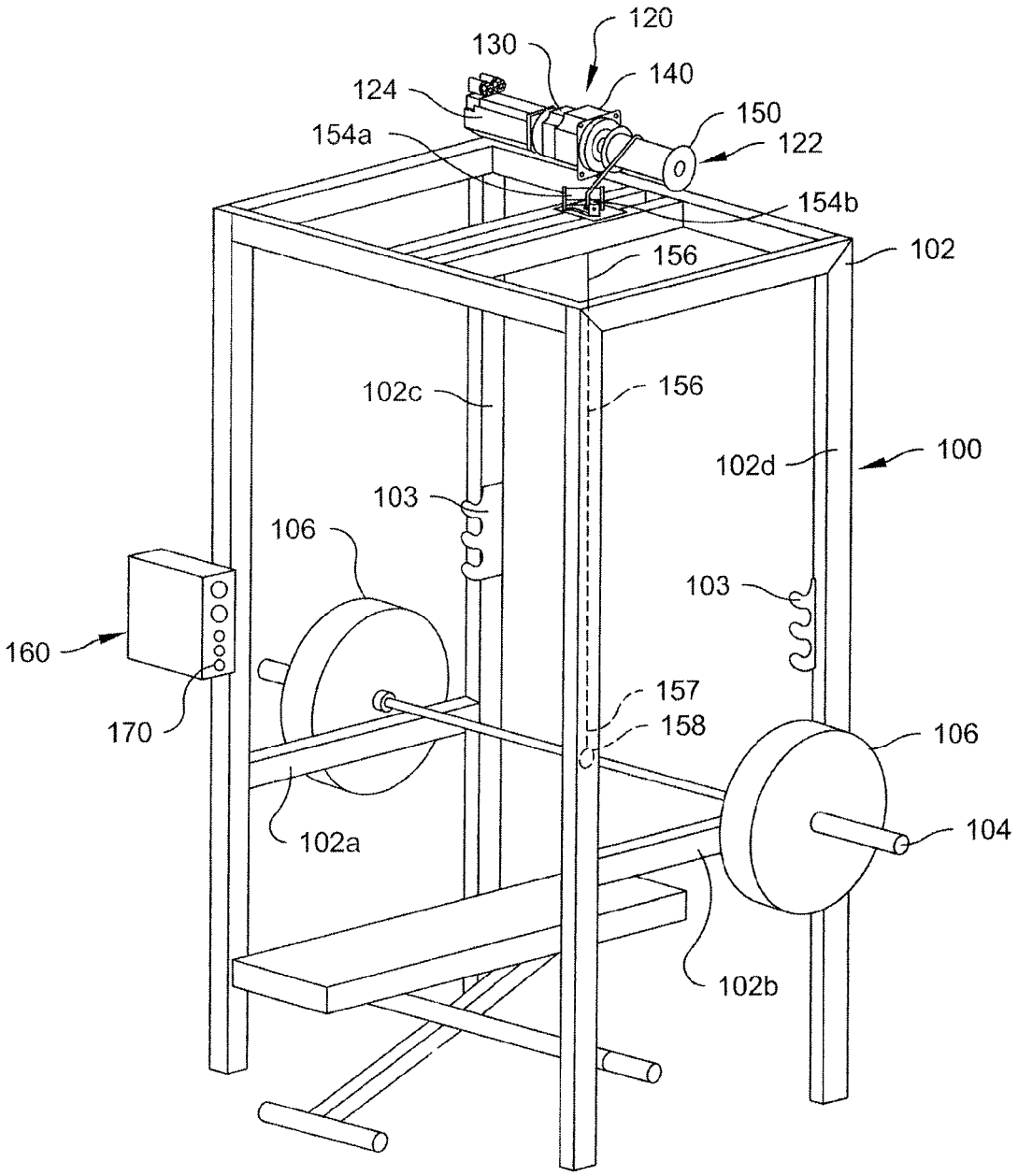
FIG. 1 depicts an exercise device combined with an assist force delivery apparatus of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the stated component and designated parts thereof. The terminology includes the words above specifically mentioned, derivatives thereof and words of similar import.

Assist Force refers to a force applied to a primary load interface (PLI) for the purpose of reducing the net effective load otherwise being provided to the PLI by an unopposed/unassisted primary variable load (PVL), the user moved load. An assist force may be constant or vary over time and/or position of the primary load interface.

Concentric Movement refers to that portion of the cyclic or repetitive motion of an exercise where the targeted muscle group continually contracts while the weight is in motion from a start position to a finish position, the latter being the concentric range limit. Examples include a classic bench-press, performed from a supine position, where the weight bar is moved from the starting position at the chest upward to the arms-extended finish position or, in a squat exercise, where the weight is moved from a squat position to a standing position.

Concentric Range Limit is a pre-determined position of travel for the PLI that defines the completion of the concentric movement.

Eccentric Movement is the complement of the concentric movement defined above, where the weight in a free weight resistive exercise is returned to its starting position, usually at or near an eccentric range limit. The targeted muscle group is progressively extended and relaxed from full contraction at the concentric endpoint/range limit back to a starting point of the next concentric movement, where it is mostly or completely relaxed.

Eccentric Range Limit is a pre-determined position of travel for the PLI that establishes the completion of the eccentric movement. This may be the same as, or slightly different than, the original rest or start position of the PLI before the beginning of a set of exercise repetitions.

Human Machine Interface (HMI) is a device or collection of devices which allows a person to control the operation of the assist system, i.e., turn on/off, start/stop/pause, enter parameters of the exercise and, depending on system complexity, also communicate with, i.e., receive/retrieve/view information from, install or modify program instructions for, and/or perform limited troubleshooting on the system. In its most rudimentary form an HMI may be individual switches with one or more conventional manual actuators (push buttons, dials, etc.). In a more sophisticated implementation, an HMI might also include a visual display and keyboard or touch-screen computer display.

Lower Safety Limit refers to a physical position limit established for certain free weight exercise movements such as a bench press below which the PLI will not be allowed to move, so as to protect the subject from physical harm. This is usually set at or slightly below the eccentric range limit.

Primary Load Interface (or PLI) is a mechanical medium to which is applied the Primary Variable Load or PVL and with which the exercising subject would make physical contact and usually intend to move to move the PVL. The PVL may be mechanically affixed directly to the PLI (i.e. plates on a bar grabbed by the user) or via other connective media such as a cable or hydraulic linkage, etc. Examples of the latter include a leg press machine having a movable plate or platform against which the user would push with his feet or most weight stack/pin select machines that normally employ a cable and handle PLI between the PVL weight stack and the user.

Primary Variable Load or PVL is the primary weight, load or opposing force which is applied to a Primary Load Interface, and which must be matched or exceeded during an exercise by a subject to be moved by the subject and which, by design of the system or machine providing the load, is not constrained to be a single permanent value. A common example would be variations of multiple weight plates that may be loaded onto a bar or in a pulley-cable plate system wherein placement of a movable connecting pin within a stack of plates determines a specific quantity of plates and thus the amount of weight to be hoisted by movement of the cable.

Repetition or Rep refers to a complete movement cycle comprised of both a concentric and eccentric movement.

Servo Motor is a specialized form of electrical motor where the physical position of the output device, normally a spinning shaft, can be controlled as a function of time. Servo motors are typically used in a closed loop architecture such that one or more internal and/or sometime external feedback sensors are used to confirm that the motor is in the desired position, or at the desired velocity or torque. As used herein, an integrated servo motor has at least a self contained sensor such as an angular encoder which may divide a complete 360° revolution of the output shaft into tens of thousands, or even millions of discrete locations and output a position signal for use in controlling the operation of the motor. A feature of servo motors is that, when properly sized, they are practicably insensitive to the loads resisting their movement and are able to satisfy the position-time demand by essentially varying the electric current they draw from the source as needed, in real time, to provide sufficient power to match or overcome any dynamic load variation. This ability of a servo-motor to vary current draw introduces resultant motor torque itself as an alternate controllable output parameter, in addition to position. Since current relates to power directly as $$P = V \times I \text{(voltage times current)}$$

when applied to a rotating shaft of known radius, a known output torque is also then available, and correlates directly with current draw. Servo motors may thus be commanded to move to known positions or, known positions as a function of time (which correlates to various velocity and acceleration profiles) or, alternately, to maintain a specific power production which then correlates to a constant applied force or, vary the power production as a function of time or in real-time response to a system's, or a person's demand.

Servo Motor Drive is a device that accepts power demand input signals from a separate controller and uses those signals to then vary the current being fed to the servo motor under control of the drive. A servo motor drive might receive digitized instructions from a processor to move the servo-motor to a specific position at a specific time or, when continuous motion is desired, a continuous stream of successive positions over successive points in time or, a series of discrete command sets such that the motor output shaft can be varied infinitely along a time continuum to create non-linear speed, acceleration and motion profiles. It can also supply current at a predetermined level to generate a selected output torque, regardless of angular position of the armature.

Station will encompass exercise and rehabilitation machines or stands employing weights, the latter typically being nothing more than a frame to support a weighted bar prior to and after use.

User Force refers to an amount of force generated by a subject contracting an active, and directly controllable muscle or muscle group, often associated with a moveable limb or limbs and commonly during an exercise repetition. Depending on the physical constraints of the PLI and/or the magnitude of the PVL relative to the user force, the PLI may or may not move.

Apparatus and methods of the present invention are designed to provide an Assistive Force to a user Primary Load Interface supporting or connected with a Primary Variable Load (free weights or weight stack in a machine) to supplement User Force during a Concentric portion of a repetitive exercise having Eccentric and Concentric portions moving the Primary Variable Load.

FIG. 1 depicts a free weight, bench press exercise stand 100 as might be retro-fitted with the present invention and include a frame 102, a primary load interface in the form of a bar 104, a primary variable load in the form of one or more pairs of disk weights 106 conventionally mounted on either end of the bar. The frame 102 may be provided cross members 102*a*, 102*b* to provide rigidity and to define a lowermost mechanical stop below which the bar 104 will not pass. Sets of bar supports 103 fixedly mounted to upright beams 102*c*, 102*d* of the frame 102 higher than the cross members 102*a*, 102*b* provide selective bar start or rest positions where the user is expected to start and finish an exercise and store the bar between exercises.

A first embodiment assist apparatus according to the present invention is indicated generally at 120 and is also preferably fixedly secured to the frame 102. Apparatus 120 preferably includes at least a servo motor 130 or equivalent rotary actuator, a gearbox 140 or equivalent transmission, and a reel 150. These components are fixedly connected together in a linear assistive force or "assist assembly" 122 for operation, the motor 130 driving the gear box 140 driving the reel 150. A flexible assist force member preferably in the form of a metallic cable 156, is wound around the reel 150. A first end of the cable 156 (hidden) is secured to the reel in a conventional fashion. The second or "free" end 157 is provided in a configuration for attachment directly or indirectly with the variable primary load 106, for example by the provision of mounting hardware 158 in the form of a clam shell clamp to be fixedly secured to the center of the primary load interface/bar 104. Additional hardware in the form of cable guides such as a pair of stacked rollers 154*a*, 154*b* may be provided to install arranged at right angles on the frame 102 to redirect the cable 156 from the reel 150 to a position vertically opposing the center of the primary variable load 106. The assembly 122 itself is also preferably fixedly secured in a horizontal orientation through mounting hardware such as a mounting platform 124 fixedly secured to the bottom of the motor 130, the platform 124 then being fixedly secured to the existing frame 102. Platform 124 is a box and provides a cantilever mounting of the assembly 122. Other platforms that might be used include an L shaped joined pair of mounting plates with holes for motor mounting at one end and holes along the remaining side for direct or indirect frame attachment. Another would be a C shaped set of three joined mounting plates where a second, end plate might be provided opposing the motor mounting end plate and provided with a bearing to receive the free end of a shaft extending from the distal end of the reel 150 to support the assembly at both ends. Conventional cable guides such as crossed rollers 152 or pulley(s) to be described may also be provided. Conventional fasteners such as nuts and bolts, radiator clamps, screws (none depicted) are also preferably provided to permit removable mounting of the assembly 122 and remainder of the apparatus 120 to an existing frame 102 with a minimum assortment of tools and a minimum amount of site preparation.

Figure 2:
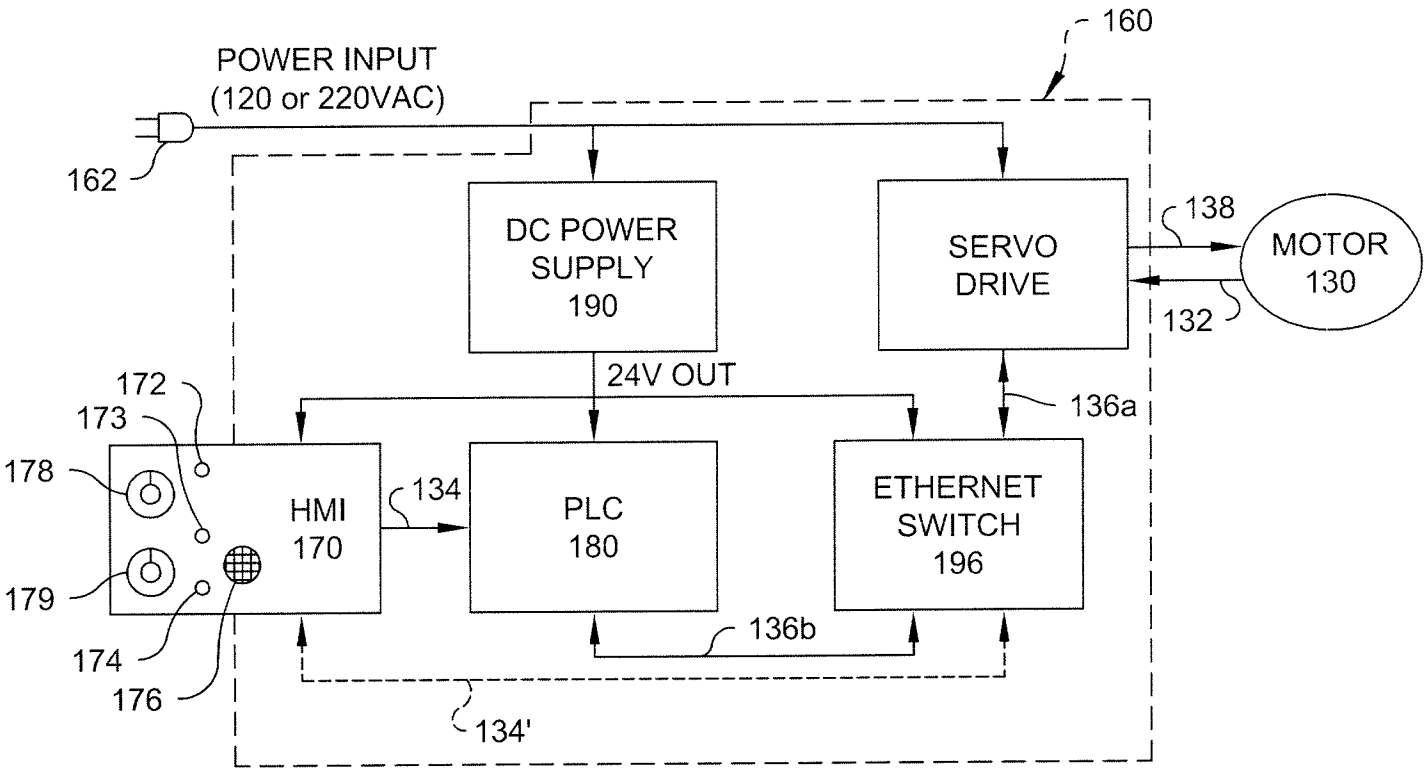
FIG. 2 is a block diagram of the electrical components of the apparatus of FIG. 1.

Electrical/electronic components of the apparatus 120 are best seen in the FIG. 2 block diagram. These depicted components provide a most basic form of the apparatus 120 and preferably include a human-machine interface (HMI) 170, a main digital controller 180, which in its simplest and least expensive form is suggestedly a programmable logic controller (PLC 180) such as an Allen Bradley CompactLogic™ PLC 180, a motor or "servo" drive 134 compatible with the selected servo motor and a DC power supply 190 to supply necessary DC power to the other circuitry from a conventional AC power source accessed through a plug 162. The identified servo drive 134 converts AC power into a higher voltage, DC signal that is modulated by the drive to vary the power supplied to the servo motor 130 on cable 138. The motor supplies an analog position signal back to the drive 134 on line 132 for control. The drive 134 converts that signal into a form the main digital controller/PLC 180 can use and preferably passes it to the PLC 180 through an Ethernet switch 196 along lines 136*a*, 136*b*. The PLC 180 returns control signals through Ethernet switch 196 and lines 136*a*, 136*b*, which the drive 134 implements through varying a signal it applies to the motor to power the motor. The PLC 180 is thus operably connected with the servo motor 130 through the servo drive 134, switch 196 and lines 132, 136*a*, 136*b* to receive at least angular position sensor data from the motor 130 and to supply control signals to the drive to variably control the amount of power supplied to the motor 130 along line 138. The PLC 180 180 is further operably connected with the HMI 170 to receive user inputs to set up the apparatus 120 to provide a user selected assistive force and to provide feedback to the user. Again, in its simplest form, the HMI 170 might be provided by a set of individual manual electromechanical actuators such as a multipurpose button or plurality of buttons 172, 173, 174 connected with momentary contact switches to start/stop the apparatus 120 and/or begin/end the exercise and permit the user to enter values such as concentric/eccentric range limits, respectively. Dials 178, 179 connected with angular encoders, rheostats or other conventional rotary switches may be provided to enter the amount of assistive force to be generated, in pounds (or kilograms), during the assistive portion of the exercise cycle/repetition and the number of repetitions to be performed. The latter would be desirable as on the last cycle of the exercise, when the user is most exhausted, assist would normally be removed as the user attempts to lower the bar 104 back to the supports 103 in what would be the beginning of an eccentric movement. By selecting a specific number of repetitions, the main digital controller 180 can be programmed to maintain assist after completion of the last scheduled repetition. If a rep selector feature is implemented, there should also be a control (such as a setting on the dial 179), which represents an unlimited number of reps so that the assist force is not applied after completion of any concentric movement. In such a component configured HMI, a direct/hard wire connection 134 is the most convenient. For higher level, digital HMI's as will be discussed later, connection with the main digital controller 180 might be two way through the Ethernet switch 196 and a line 134'. A speaker 176 may be provided to squawk under command of the PLC 180 to signal entry of user selections, limits, beginning/end of exercise, approach of limits during a repetition, etc. These control components might be provided together in a single control box 160, that is also preferably configured to be fixedly secured to one or another member 102*f* of the existing frame 102 through suitably mounting hardware (again not depicted).

Use of a commercially available servo motor 130 provides particular advantages. Commercially available motors are already configured to permit one complete rotation of the armature to be divided up into a million or more discrete points. The present application has no need for such fine resolution but a resolution of at least hundreds of points are suggested and thousands of points are preferred. Furthermore, integrated servo motors include one or more built-in sensors including at least an absolute position encoder as well as non-volatile onboard memory so that as a motor armature spins hundreds or even thousands of revolutions away from its initial 'home' or 'zero' position, it would always know exactly where it is in relation to that origin and therefore how to get exactly back to its home position. One suggested assembly 122 could be provided by an Allen Bradley MPL-A33OP-MJ24AA servo motor 130 with a compatible Allen Bradley Kinetix™ 350 servo drive and a Parker PEN090-005S7 gearbox 140 having a 5:1 reduction ratio rotating a four to six inch diameter reel 150. In the present type of use, the servo motor 130 would be called upon to make only a very limited number of revolutions, generally no more than twenty to thirty and typically no more than ten (converting into six to two revolutions of the reel 150 with the 5:1 reduction of the transmission) so that "growth" of the effective diameter of the reel 150 from gathering cable 156 would be immaterial. Other combinations of discrete motor, gearbox and reels can be specified to produce different ranges of assist. The beauty of servo motor/drive combinations like the aforesaid Allen Bradley pair is that they can be configured electronically for torque or position control and can be toggled electronically between the two as desired. For assist, torque control mode would be used. The aforesaid Allen Bradley pair can provide up to one hundred lb.-feet of torque, which can be controlled on a percentage basis. Thus for ten lb.-feet output from the motor, the drive 136 can be commanded by the PLC 180 to operate the motor at ten percent. This enables simple generation of a constant output torque providing constant assist forces or more complicated time varying torque profiles for time varying assist force profiles.

Figure 3:
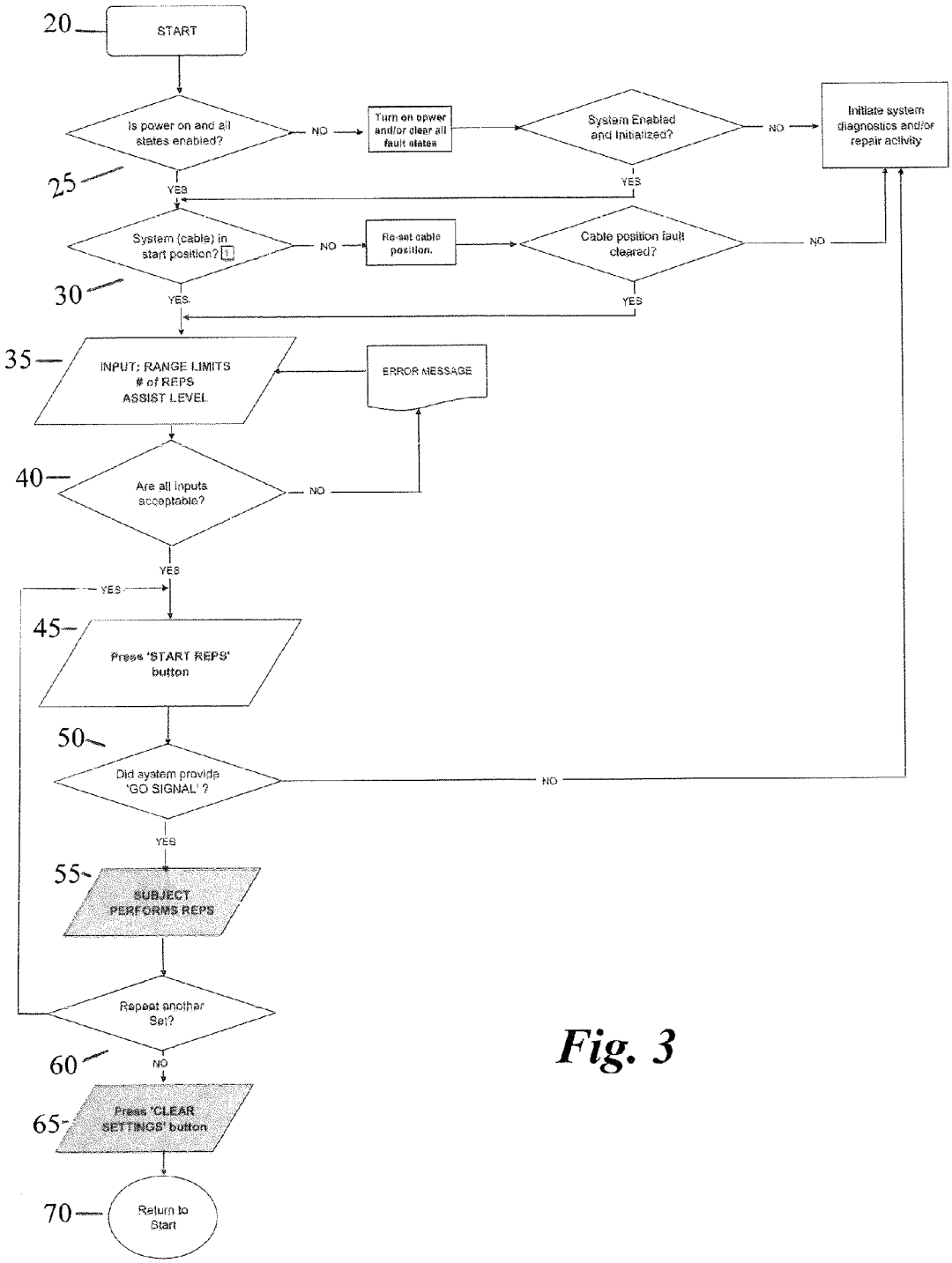
FIG. 3 is a flow chart for operating the apparatus of FIGS. 1-2.

Operation of the most basic form of the apparatus 120 will now be explained reference to FIG. 3. Initialization of the apparatus 120 for operation is started at 20 by supplying electric power to apparatus 120 and hitting a START/BEGIN button 172. After completion of a programmed internal initialization cycle at 25, 30 of the PLC 180 180, that preferably includes start or rest of the starting position of the bar on the supports 103, the user selected information is entered at 35. A user lies on the bench, removes an unweighted interface/bar 104 from the supports 103 and raises it to a desired extended upper position constituting the concentric range limit. An attendant/spotter depresses a second button 173 signaling the PLC 180 that this is the position of the cable at the desired upper/concentric range limit. Similarly, the user lowers the unweighted interface bar 104 to a desired lowermost position and the attendant/spotter depresses the third button 174 to signal the PLC 180 the position of cable at the desired lower/eccentric range limit. The PLC 180 is preferably programmed to hold the servo motor 130 at a modest torque level to maintain a minor static or drag load on the flexible assist member at least during this initialization process (and preferably whenever the apparatus is powered but not in use) sufficient to prevent the cable 156 from going slack or sagging, suggestedly no more than two pounds and preferably only a pound or less. The PLC 180 is preferably configured to store the start position of the bar 104 in the supports 103 and the upper and lower range limit positions of the bar 104 from position data supplied by the integral servo motor 130. Before or after entry of the upper and lower limits, an assist weight and a number of repetitions may be dialed in by the user or an assistant via dials 178, 179. After the primary variable load 106 has been added to the bar 104, the a START/BEGIN button 172 is again depressed at 45 to signal start of the exercise to the PLC 180. The exercise cycle begins with the bar 104 in the starting position on a selected level of the bar supports 103. The PLC 180 may or may not be programmed to initially supply an assistive force as the bar 104 is raised from the starting position on the supports 103 to the upper/concentric range limit position. After reaching the upper/concentric range limit position, the user begins the eccentric movement portion of the exercise by lowering the bar 104 towards his chest. During this portion of the cycle, the PLC 180 is programmed to create only a very modest torque output from the motor 130 to provide a drag or static force that is preferably no more than is necessary to keep the cable 156 relatively taut (i.e., to prevent slack) as the bar 104 is lowered. When the PLC 180 recognizes that the bar 104 has reached the lower/eccentric range limit position of the cycle, the PLC 180 changes control signals to the servo drive 134 to supply greater power to the servo motor 130 to generate a greater torque sufficient to equal the selected level of assistive force. The assembly 122 provides the selected level of assistive force as the bar 104 is raised during the concentric portion of the cycle or repetition. When the PLC 180 senses that the bar 104 has again reached the upper/concentric range limit position, it controls the servo drive 134 to again reduce current to the motor 130 to essentially eliminate any significant assistive force generated by the assembly 122 and cable 156 (other than the static/drag force) and the cycle is repeated until the dialed in number of repetitions have been performed and the exercise completed at 55. The START/BEGIN button 172 can again be depressed at 60 to start another repetition set or depressed again at 65 without bar movement to clear the system. The PLC 180 could be programmed with an algorithm to calculate a necessary power value to generate a level of torque necessary to provide the desired assist force at the end of the assist cable 156. However, with a limited number of discrete assist force values that might be selected by a user, the PLC 180 might simply be provided with a look-up table which contains the data necessary to generate the appropriate control signals to the servo drive 132 to generate the torque necessary to provide the selected assist force.

Even with this simple control system, the PLC 180 might be preprogrammed to include a lower safety limit position value that would not normally be changed and for which the servo drive would provide maximum torque in order to maintain. Many servo motors including the aforesaid Allen Bradley motor are equipped with self braking circuits which will activate to attempt to maintain an armature position in the event of power loss. The assembly 122 might also or alternatively be provided with an electro-mechanical brake designed to engage some rotary portion of the assembly 122 or the cable 156 in the event of no power or loss of power, for example, one or more spring-loaded shoes or pads maintained disengaged by electromagnet(s). Furthermore, the PLC 180 can be programmed as an additional safety measure to monitor position and/or movement of the primary load interface/bar 104 to provide an assistive force if the bar is moved too quickly during an eccentric portion of a movement, indicating possible problems by the user, or if the bar remains stationary or nearly stationary in a position between limits where the bar should be moving, again indicating a possible problem with the user. Position output from the servo motor enables the provision of all of these features.

Furthermore, with sufficient memory, exercise parameters such as the concentric/eccentric range limit values, number of repetitions, etc. might be stored for access by the PLC 180 for repeated use and for multiple different users, as might a history of exercises for a given user. Programming and memory may also be provided to permit user identification to be entered as part of the initialization program, for example through the provision of a number key pad, touch screen or a swipe reader, which would result in the last set or some other pre-stored set of exercise parameters being entered automatically for the indentified user.

Figure 4:
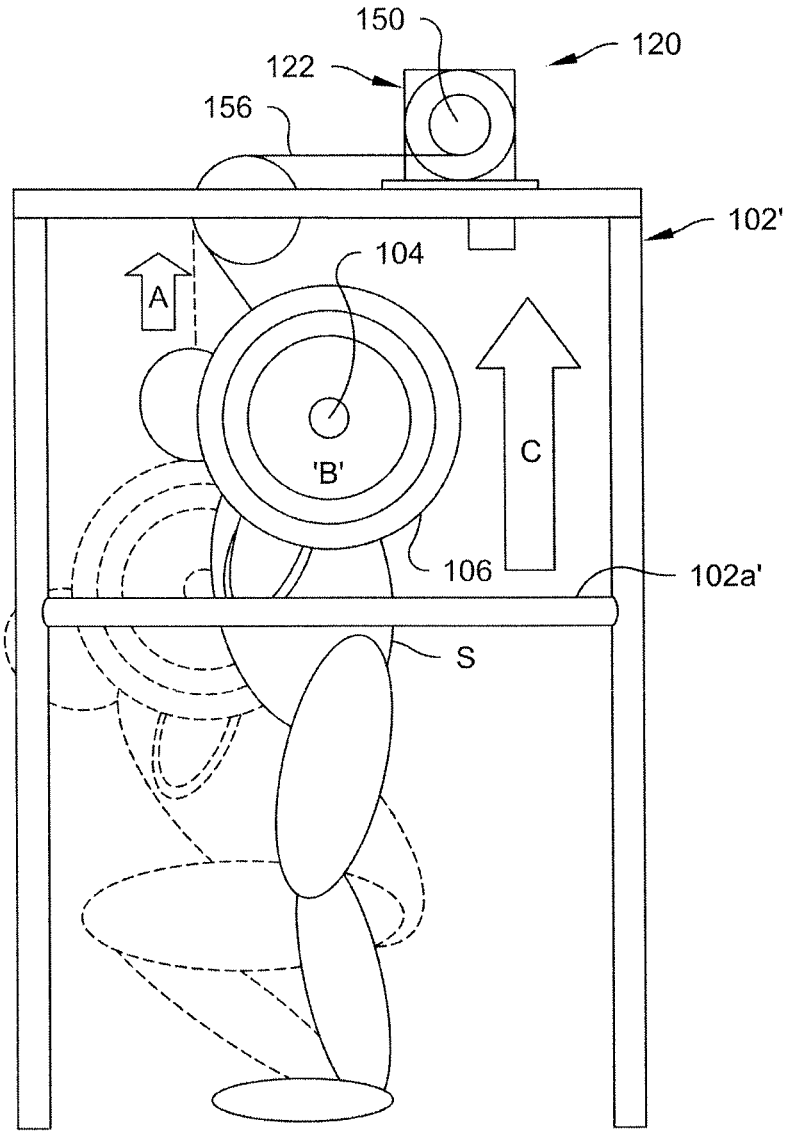
FIG. 4 illustrates diagrammatically a slightly different mounting and arrangement of the assist force delivery apparatus of FIG. 1 in a first, "concentric" movement of a squat exercise.
Figure 5:
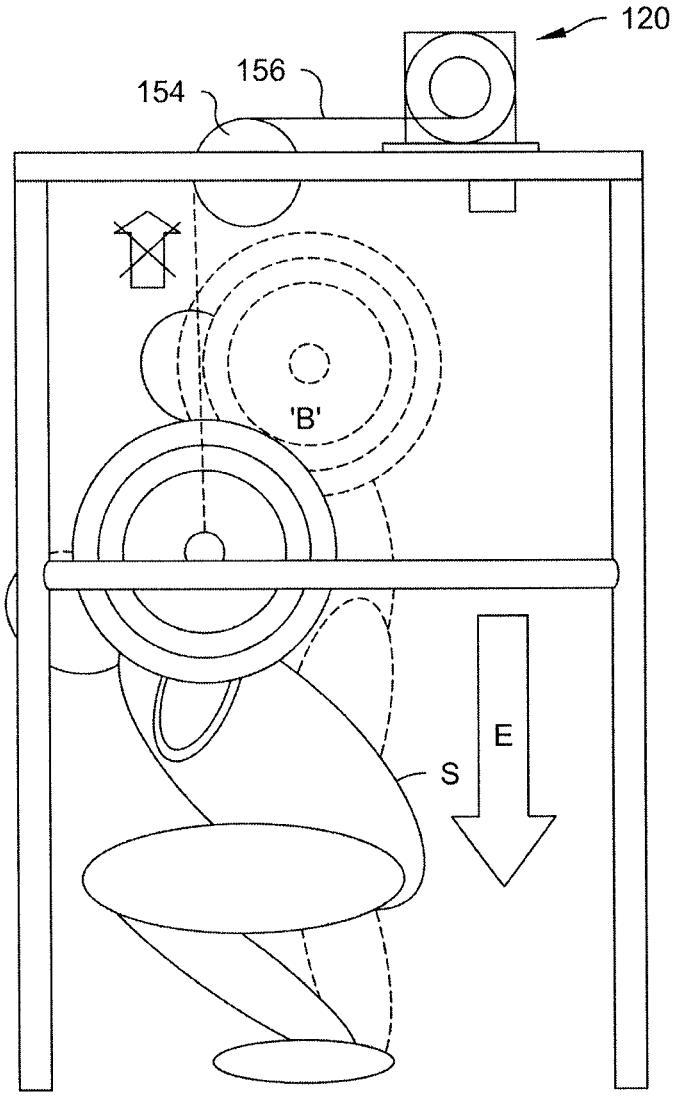
FIG. 5 illustrates diagrammatically the apparatus of FIG. 4 in a second, "eccentric" movement of the squat exercise.

FIGS. 4-5 illustrates diagrammatically a slightly different mounting and arrangement of the assistive force delivery apparatus 120 of FIG. 1 for a squat exercise stand. Referring to the figures, it will be seen initially that the original cable guides in the form of crossed rollers 152 of the first installation of FIG. 1 has been replaced by a pulley 154. In this set-up, the exercise begins with the bar 104 in a lowermost position resting on cross members 102*a*' of the frame 102' but supports 103 like those in the bench press stand 100 might be provided. Initial limit position values, selected assist force, number of repetition and similar data would be entered as before and the exercise begun. In this configuration, an assistive force A is supplied immediately by the assembly 122 as the subject S straightens up and raises the bar 104 and load 106 during the concentric movement portion of the cycle (phantom lower to solid upper positions in FIG. 4). When the PLC 180 senses the bar 104 has reached the upper/concentric range limit position (solid subject S in FIG. 4 and phantom in FIG. 5), the assist force is again effectively removed as the subject S descends into a squat position (phantom in FIG. 4, solid in FIG. 5) until the lower/eccentric range limit position is again reached, in response to which the PLC 180 regenerates the selected assist force A for the next concentric movement portion of the exercise.

Figure 6:
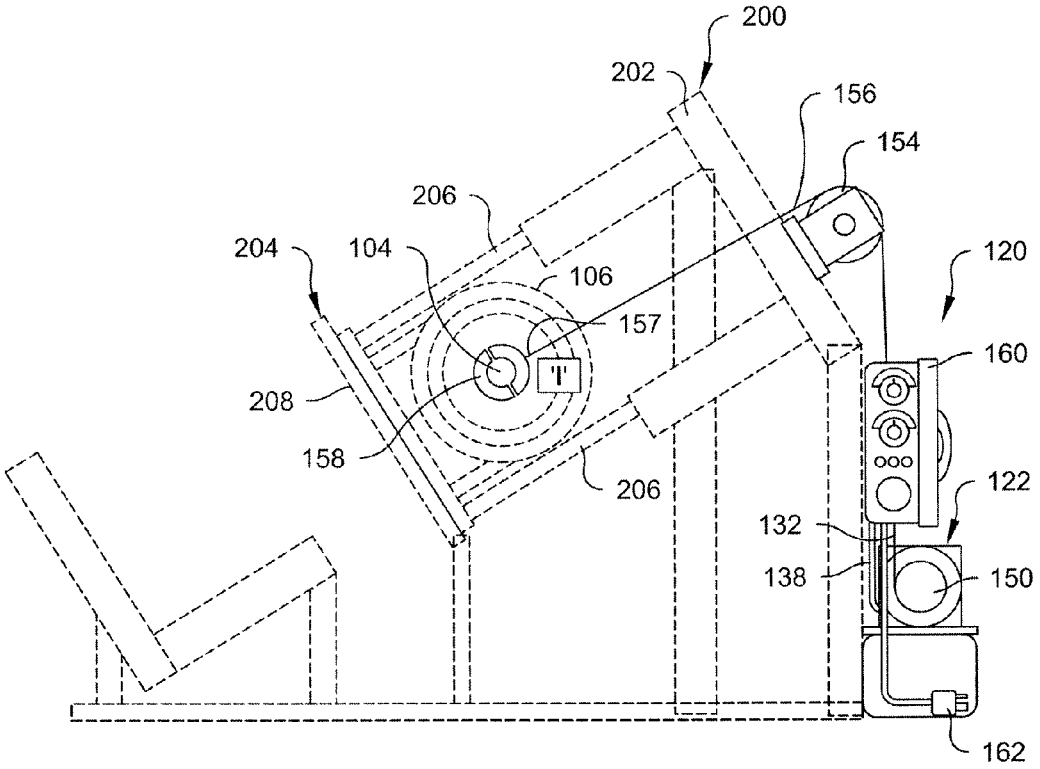
FIG. 6 illustrates diagrammatically another slightly different mounting and arrangement of the assist force delivery apparatus of FIG. 1 as it might be supplied in a kit or accessory and installed in a conventional, commercially available leg press machine.

FIG. 6 illustrates diagrammatically another possible installation of the assist apparatus 120 with another type of "free weight" exercise stand 200 for leg presses. Stand 200 includes a frame 202, a primary load interface in the form of a bar 104, a primary variable load in the form of one or more pairs of disk weights 106 conventionally mounted on either end of the bar. This particular stand 200 supports bar 104 on a sub-frame 204 supported on telescopic arms 206 and moved by pushing a footplate 208 portion of the sub-frame 204. The assist apparatus 120 is secured to one or more members of the frame 202. Flexible assist member/cable 156 extends from reel 150 over a pulley 154 to a second end 157 where it is secured to the bar 104 via the clam shell clamp 158. The assembly 122 and control box 160 can be secured to one or another of the upright members of the frame 202. The load 106 and bar 104 are located at the eccentric-range limit position marking the eccentric to concentric transition.

It will be appreciated that the apparatus 120 might be supplied as a kit including the assist force assembly 122, assist force cable 156, cable redirection hardware such as rollers 152 and/or pulleys 154, control box 160 and related electrical connections 132, 136, 138, 162, etc. and conventional mounting hardware 147, 158, etc. for mounting to the circular or square tubular members that form the frame of most conventional weight exercise and rehabilitation machines and stands.

Figure 7:
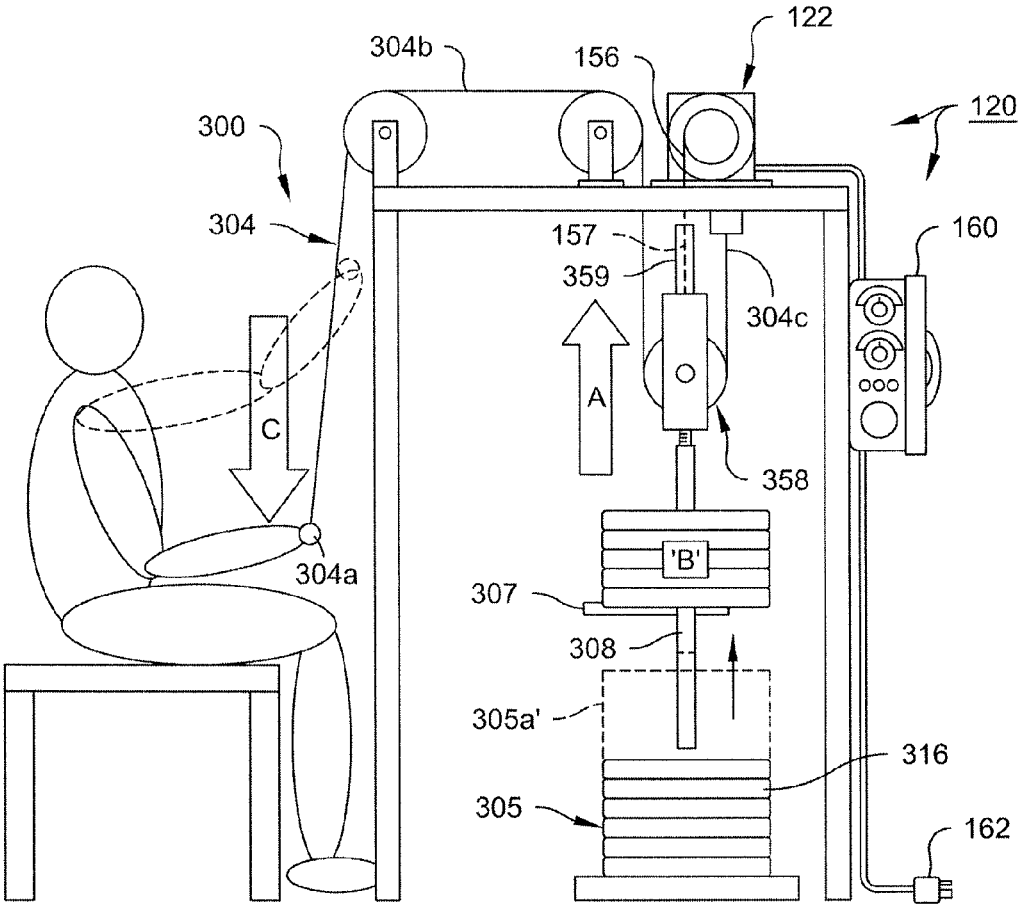
FIG. 7 illustrates diagrammatically another slightly different mounting and arrangement of the assist force delivery apparatus of FIG. 1 as it might be supplied as a kit or accessory and installed in a conventional, commercially available weight stack machine.

FIG. 7 depicts diagrammatically, another suggested installation of the same basic assist apparatus 120 with a different type of exercise machine 300 employing a stack 305 of weight plates 306, subsets of which may be selected by the passage of a pin 307 through a weight bar 308 that extends vertically down through the height of the stack. This is a much more common form of exercise machine than the "free weight" stands previously described.

The same basic components of the apparatus 120 are used including assembly 122 and control box 160 with electrical and electronic components. This time, however, the second/free end 157 of flexible assist member/cable 156 attaches to a movable pulley 358 on a connector 359. The primary load interface (PLI) 304 in this machine is a handle or bar 304*a*, connected with another cable 304*b* having an end 304*c* fixedly connected to the frame 302. The parameters of the human-machine interface 170 would be set in a similar fashion with no weight plates or just one or two weight plates 306 attached to the end of cable 156 to keep it taunt as at least an upper position limit is entered. At the starting point (phantom subject's arm and weight stack 305*a*' in FIG. 7), there is no primary load on the PLI 304 as the stack 305 is self supporting. The concentric movement of the subject's arm is down (arrow C) from the upper (phantom) arm position to the lower (solid) arm position in FIG. 7. With that movement, the upper portion or subset of the weight stack 305 above pin 307 is raised from the lower (phantom) position 305*a*' to the higher (solid) position 305*a* while an assist force (A) is supplied by the apparatus 120. The eccentric movement is the reverse (from the arm down to the arm up position) during which movement only enough torque is generated by the apparatus 120 to keep the cable 156 taut.

Figure 11:
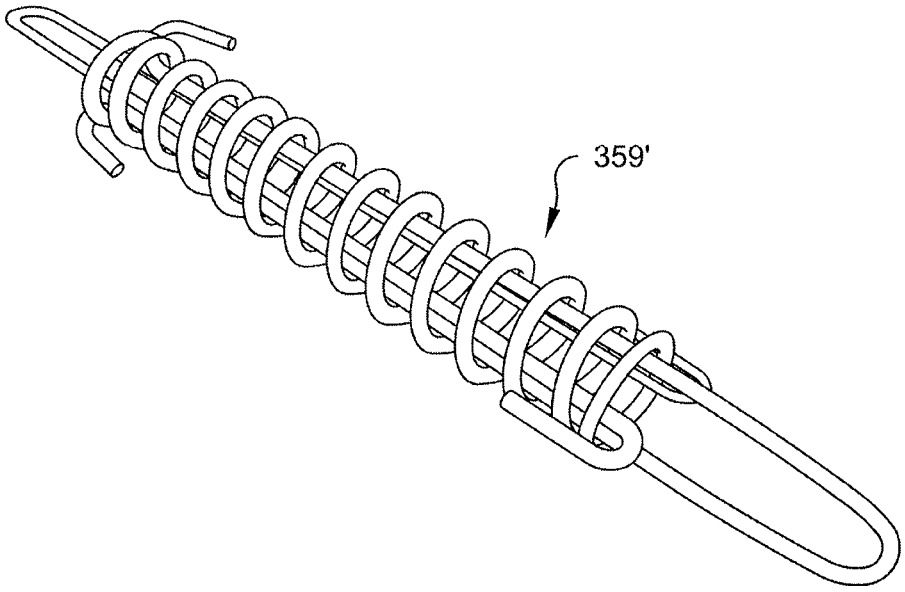
FIG. 11 depicts an in-line spring tensioner that might be used to connect a flexible assist member to the primary load interface.

If the stand 300 were not originally supplied with a movable pulley like 358, the second end of cable 304*b* would have been originally attached to the upper end of the weight bar 308. Since in this embodiment, the primary variable load 306 is being supported by the PLI cable 304*b* on both sides of the movable pulley 358, the modification of the stand to this configuration would effectively halve the load being lifted by the PLI cable 304*b*. In other words, a ten pound pull on cable 304*b* would lift twenty pounds of weight plates 306. Accordingly, the parameters of the current/torque conversion in the PLC 180 170 would have to be modified to reflect the different assist forces that would be required. For example, a forty pound assist force would have to be provided to generate an effective twenty pound assist at the PLI handle 304*a*. An alternative would be to supply an assist cable 156 with mounting hardward which would permit the cable 156 to be attached to the top of the weight bar 308 with the end of the PVI cable 304*b*. For example, cable 156 could be provided with a ring at its end 157 and mounting hardware that would attach to the top of the weight bar 308 such as an S shaped hook that could be connected between the ring at the end 157 of the cable 156 and a ring provided at the top of the weight bar 308 to similarly receive an end of the PLI cable 304*b*. Yet another alternative would be to custom make a replacement for the particular hardware an exercise machine manufacture would normally supply with its machine to attach its PVI cable directly to the weight bar 308 to further connect the end 157 of the assist cable 156. An additional feature and possible alternative mode of connection might be spring tensioner 359' like that shown in FIG. 11 which could be positioned between the yoke supporting pulley 358 and the ends of the cables 304*b*, 156 to provide shock absorption capability.

Figure 8:
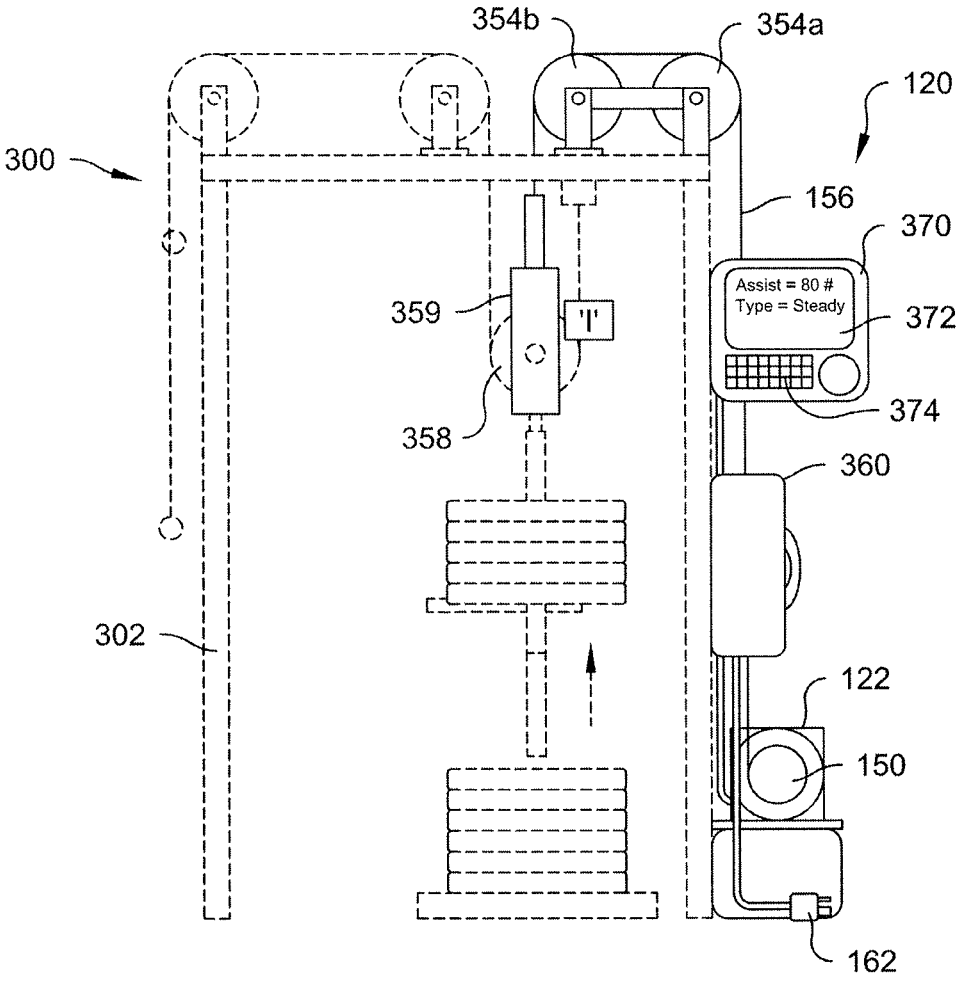
FIG. 8 illustrates diagrammatic another configuration and installation of the assist force delivery apparatus of the present invention as it might be supplied as a kit or accessory for "floor" mounting with a different human-machine interface.

FIG. 8 depicts diagrammatically another slightly modified form of the apparatus 120 in a "floor" mount where the assembly 122 is located at or near the bottom of the frame 302 and the assist force cable 156 is extended from the reel 150 over a pair of cable guides in the form of pulleys 358*a*, 358*b* at the top of the frame 302 and down to the movable pulley 358. In this embodiment, the human-machine interface is indicated at 370 and the control box without the HMI components is indicated at 360. The HMI 370 is a higher level machine with visual display 372 and keyboard 374 to provide a conventional, computer-type digital graphic user interface. HMI 370 might be, for example, an Allen Bradley 2711P-T7C4D8 operator interface, which might be used with the previously identified Allen Bradley servo motor and other Allen Bradley components such as a Kinetix™ 350 servo drive, an Allen Bradley 1606-XL 120D DC power supply and the Ethernet switch 196.

Figure 9:
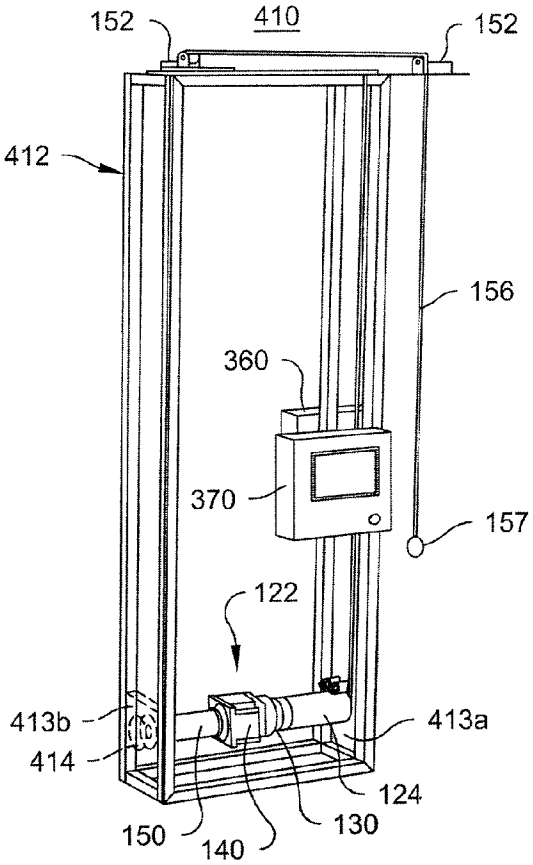
FIG. 9 depicts an apparatus with a mounting tower.

FIG. 9 depicts another embodiment of the present invention that might be supplied in kit form for "after-market" attachment to an existing/conventional weight machine or other exercise stand. Assist apparatus 410 includes the previously described assist force assembly 122 mounted with a control box 360 on its own frame or "tower" 412 and provided with a digital human machine interface 370 that could be mounted to the frame 412 or the frame 102 of the stand 100. Necessary cable guides such as rollers 152 and/or pulleys may be supplied with the kit or ordered as required. The assembly 122 can be mounted to a plate 413*a* at one (the right) end of the tower 412 though a box platform 124 of a selected length. If desired, the tower 412 could be provided with a second plate 413*b* (in phantom) at an opposing (left) end of the tower with a bearing 414 (also in phantom) to receive a distal end of the output shaft of the gearbox 140 that is selected to be sufficiently long to extend entirely through the reel 150 and into the bearing, in order to help support the load on the reel 150 from the cable 156 at both ends of the linear assembly 122.

Figure 10:
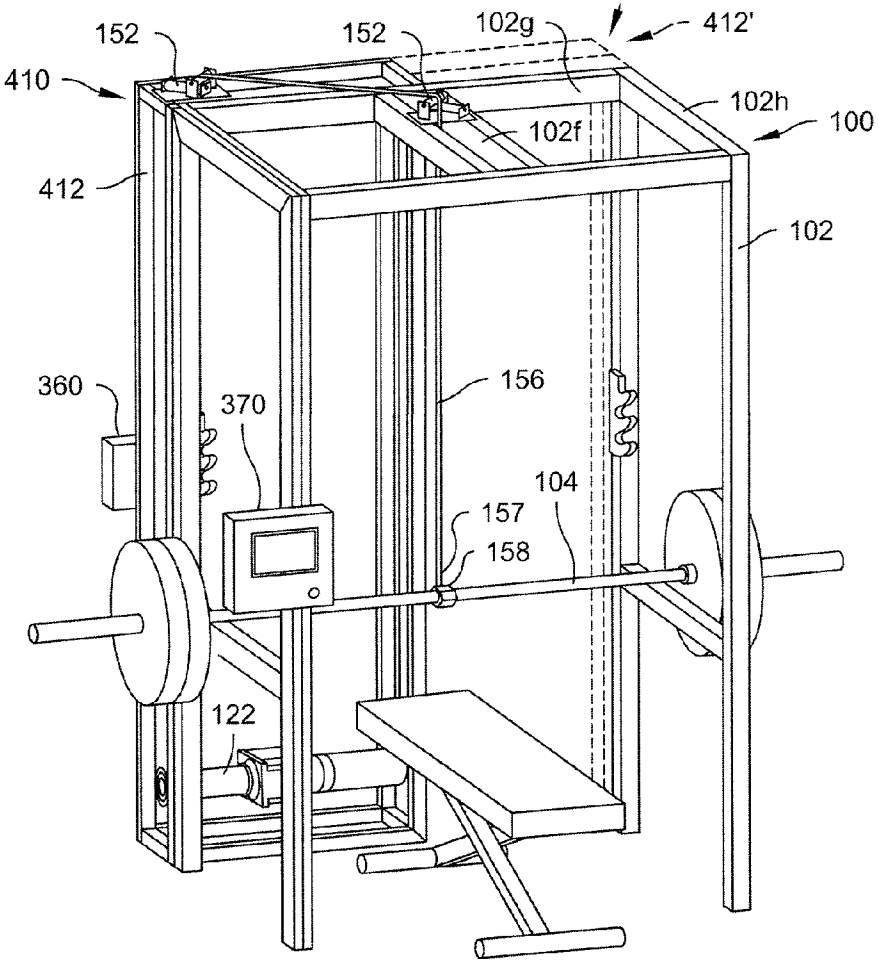
FIG. 10 depicts possible installations of the apparatus and tower of FIG. 9.

FIG. 10 shows one possible connection of the apparatus 410 of FIG. 9 on the bench press stand 100 of FIG. 1. In this installation, the top member and left vertical member of frame 412 are against similar members of the stand frame 102 and can be secured thereto along those frame members. Alternatively, the tower of the apparatus can be positioned at the right rear end of the stand frame 102, where it is indicated in phantom at 412' and 410', respectively. In that arrangement, the reel 150 and assist cable 156 would be more laterally aligned with the center of the stand 100 and the weight bar 104. It will be appreciated that the high tower 412 could be replaced with a smaller cage, preferably still having the mounting end plates 413*a*, 413*b* and bearing 414 (FIG. 9) and be mounted at or near the bottom of the frame 102 or across the top of the frame 102 using the central upper frame member(s) 102*f* for support with the rear and side upper frame members 102*g*, 102*h*. Other arrangements will occur to those of ordinary skill in the art to adapt the apparatus kit to different machines and frames.

The provision of a more powerful main digital controller 180 with an interactive digital HMI like 370 and greater memory would allow the apparatus to store a great deal more information and permit greater flexibility in exercises. These changes could enable the provision of a User Performance Program that analyzes a user's past data, rate of progress, bio-metric feedback and pre-determined goals to produce a forward exercise plan, or dynamically alter the active exercise plan, that will optimize that user's progress towards those goals. It could include the provision of User Specific Data, a body of data collected and electronically stored on behalf of an exercise subject that can include all related past exercise data and or user input data like height, weight and age, goals, etc. It could also include Dynamic Load/Assist Variation parameter to vary the assistive load during the exercise repetition by position, time, both or in real-time response to a subject's actions, motion or pre-programmed profiles and/or event triggers. It will be appreciated that even using a table look-up system as has been suggested, it will be possible to easily change assist forces generated for separate movements in a rep set in a step fashion and, with enough memory, it would be possible to create assist profiles that vary within a single movement. It could also include the provision of custom Load Profile as to how the PVL will be made to vary by the provision of Dynamic Load/Assist Variation with either changes in position of the PLI, or time during the repetition, or in response to real-time user responses or system sensors. It could include the provision of User Specific Parameters, pre-determined control values for PVI and/or PVL, Assistive Load values, or changes to these values over position or time, that can be set or varied for each exercise subject. It could also include the provision of User Specific Profiles that would be a combination of static user data in any point in time which, when combined with historical user specific data, can be manipulated, analyzed and presented in a way that can characterize user status and progress and may be used to plan future exercise regimens. Dynamic Load/Assist Variation refers to variations in the assistive load during the exercise repetition, varying by position, time, both or in real-time response to a subject's actions, motion or pre-programmed profiles and/or event triggers. It could include the provision of User Specific Set Points refers to pre-determined exercise parameters that can be set or varied for each exercise subject. These include position range limits, PLI velocity or acceleration, assistive force etc. and includes points that might be static or made to vary. Other aspects of prior art assistive and resistive systems may also be incorporated or adapted for incorporation into the apparatus.

Desired assist forces are expected to be in a range of between ten and two hundred-twenty pounds for exercise machines. Rehabilitation machines/stands would be expected to use smaller PVL's and require even lower assist forces. Accordingly, for rehabilitation stations, the flexible assist member may be lighter and/or the reel diameter smaller stilling permitting the use of a drag/static force less than the smallest non-zero assist force that can be selected with the apparatus, and perhaps as little as a few ounces. Assist assemblies may be configured to provide selectable assist forces over portions or subsets of those ranges, to reduce expense and cost. For example, less than two pound-feet of torque is necessary to provide ten pounds of assist force from a four inch diameter reel ($10\times1/6=10/6$), and only two and one-half pound-feet would be required with a six inch diameter reel ($10\times1/4=2.5$). The previously identified assembly 120 is configured and capable of providing assist forces over the entire expected range and is further capable of generating and maintaining a constant selected torque level during reel rotation.

Furthermore, it has been previously mentioned that during limit set-up and the eccentric movements of exercises, the servo motor must be still be operated to allow movement (feed or take-up) of the flexible assist member. During such movements, the servo motor is controlled to provide a minor force sufficient to just keep the flexible assist member taut, i.e. to prevent slack or sagging. This minor force, which might be considered a drag or static force, is to be less than the least selectable non-zero assist force, i.e. less than ten pounds at least for exercise machines, is preferably less than two pounds, and more preferably only a pound or less. The main digital controller 180 would have the drag/static force or its equivalent servo motor current control value or command pre-stored in memory. Furthermore, if desired, a zero assist force selection could be provided for users who desire to perform an exercise on the equipment without an assist force. Again, even with a "zero" assist force, same static/drag force would be desirable to take up slack and prevent overrun of the reel while feeding out cable.

It will be appreciated by those skilled in the art that changes could be made to the embodiments described above without departing from the broad inventive concept thereof. For example, it would be possible to use other types of transmissions for speed reduction between the motor and the reel. However, it is believed that a gear box with fixed speed reduction is the simplest, strongest, and safest form of transmission meeting the needs of the apparatus. While the preferred flexible assist member is a metal cable, it might be another type of cable (polymer or composite) or even a rope or a chain. If desired, connection of the second end 157 of any flexible assist member 156 might be made through a coil spring, hydraulic shock absorber or shock absorbing mechanism. It is understood, therefore, that this invention is not limited to the particular embodiments disclosed, but it is intended to cover modifications within the spirit and scope of the present invention.

The invention claimed is:

1. An assist apparatus for delivering an assist force to user moved weight of an exercise or rehabilitation station comprising:

an assist assembly including a motor and a reel operably connected with the motor so as to be rotated by the motor;

a flexible assist member having first and second opposing ends, the first end being configured to be secured to the reel so as to permit the member to be wound onto and from the reel by operation of the motor and the second end being configured to be coupled directly or indirectly with the user moved weight;

a human-machine interface configured to receive human input of variable parameters for assistance control including entry of at least a user selected non-zero assist force; and a main digital controller operably connected with at least the assist assembly and the human-machine interface, the main digital controller being preprogrammed to convert the user selected non-zero assist force into control signals suitable to operate the motor to provide the user selected non-zero assist force through the flexible assist member during each concentric movement portion of an exercise set having repeated consecutive concentric and eccentric movement portions.

2. The assist apparatus of claim 1 wherein the main digital controller is further configured to provide control signals to operate the motor to generate at the flexible assist member during at least one eccentric movement portion of the exercise set, a non-zero static force less than the user selected non-zero assist force.

3. The assist apparatus of claim 1 wherein the main digital controller is further configured to provide control signals to operate the motor to provide at the flexible assist member a non-zero drag force less than the user selected assist force prior to commencement of the exercise set.

4. The assist apparatus of claim 1 wherein the human-machine interface is configured to permit the entry of a user selected number of repetitions of the concentric and eccentric movements of the exercise set and wherein the main digital controller is further configured to provide the user selected assist force through the flexible assist member during a last eccentric movement portion of the selected number of repetitions of the exercise set.

5. The assist apparatus of claim 1 wherein the human-machine interface is configured to permit the entry of a user selected number of repetitions of the concentric and eccentric movements of the exercise set and the main digital controller is further configured to supply the user-selected assist force during an eccentric movement only following the last concentric movement portion of the selected number of repetitions of the exercise set.

6. The assist apparatus of claim 1 wherein the main digital controller is configurable to vary the assist force provided by the assist assembly during concentric movement portions of the exercise set in response to at least one of position of a primary load interface connected with the weight to be moved by a user of the apparatus and time duration of a movement portion of the exercise set.

7. The assist apparatus of claim 1 wherein the main digital controller is configurable to vary the assist force provided by the assist assembly during concentric movement portions of the exercise set in response to at least one of position of a primary load interface connected with the weight to be moved by a user of the apparatus, time duration of a movement portion of the exercise set, and a pre-programmed profile of the exercise set.

8. The assist apparatus of claim 1 wherein the main digital controller is configurable to vary the assist force provided by the assist assembly during the exercise set in response to at least one of position of a primary load interface connected with the weight to be moved by a user of the apparatus, time of a movement portion of the exercise set, a pre-programmed profile of the exercise set and an event trigger during the exercise set.

9. The assist apparatus of claim 1 wherein the main digital controller is configurable to vary the assist force provided by the assist assembly during the exercise set in response to at least one of position of a primary load interface connected with the weight to be moved by a user of the apparatus, time, a pre-programmed profile, action of a subject performing the exercise set, motion and an event trigger during the exercise set.

10. The assist apparatus of claim 1 wherein the main digital controller includes at least one look-up table configured to change in a step fashion, assist forces generated by the assist assembly for at least concentric movement portions of the exercise set.

11. The assist apparatus of claim 1 wherein the main digital controller includes at least one look-up table configured to change in a step fashion, assist forces generated by the assist assembly within at least one concentric movement portion of the exercise set.

12. The assist apparatus of claim 1 wherein the main digital controller is configured to control the motor to provide dynamic assist force variation during the exercise set.

13. The assist apparatus of claim 1 wherein the main digital controller is configured to store a load assist force profile customized for a user to control the motor to provide dynamic assist force variation during the user's exercise set.

14. The assist apparatus of claim 1 wherein assist assembly provides feedback signals to the main digital controller and wherein the main digital controller generates the control signals for the motor at least in part in response to the feedback signals.

15. The assist apparatus of claim 14 wherein the second end of the flexible assist member is operably connected directly or indirectly with a primary load interface connected with the weight to be moved by the apparatus user, and wherein the main digital controller is configured to monitor at least one of position and movement of the primary load interface from the feedback signal and to provide a non-zero assist force greater than the static force in response to movement of the primary load interface too quickly during an eccentric portion of the exercise set.

16. The assist apparatus of claim 14 wherein the second end of the flexible assist member is operably connected directly or indirectly with a primary load interface connected with the weight to be moved by the apparatus user, wherein the human-machine interface is configured for entry of a concentric movement range limit position and an eccentric movement range limit position, and wherein the main digital controller is configured to monitor at least one of position and movement of the primary load interface from the feedback signal and to provide a non-zero assist force greater than the static force in response to a movement of the primary load interface insufficiently quickly between the position limits.

17. The assist apparatus of claim 1 further comprising a motor drive operably connected between the motor and the main digital controller, the motor drive being configured to respond to control signals from the main digital controller to variably control the amount of power supplied to the motor.

18. The assist apparatus of claim 17 wherein the main digital controller and the motor drive cooperate to supply electric power to the motor to provide through the flexible assist member during at least one eccentric movement portion of an exercise repetition, a non-zero static force less than the user selected non-zero assist force.

19. A method of retrofitting an existing, motor-less exercise or rehabilitation station comprising the steps of:

collecting together separate components of the assist apparatus of claim 1 as a kit; and supplying the components in the kit to be mounted to a frame of the existing motor-less exercise or rehabilitation station.

20. A method of retrofitting an existing motor-less exercise or rehabilitation station with the assist apparatus of claim 1 comprising the steps of:

fixedly mounting the assist assembly of the assist apparatus on an existing frame of the existing station;

fixedly securing the human-machine interface and the main digital computer of the assist apparatus elsewhere on the station; and operably connecting the second end of the flexible assist member with a user moved primary load interface of the station.

21. A method of operating the assist apparatus of claim 1 comprising the steps of:

initially securing the second end of the flexible assist member with a user moved primary load interface of the station;

thereafter generating a user selected non-zero assist force with the assist assembly and supplying that assist force to the primarily load interface with the flexible assist member at least during concentric movement portions of the exercise set; and generating the non-zero static force less than the user selected assist force with the assist assembly and supplying the static force to the primary load interface with the flexible assist member at least during some eccentric movement portions of the exercise set.

22. The method of claim 21 further comprising before the generating steps, the preliminary steps of entering the user selected non-zero assist force and a selected number of repetitions of an exercise set into the human-machine interface before commencement of the exercise set.

23. The method of claim 22 further comprising a subsequent step of maintaining the user selected non-zero assist force on the primary load interface through the flexible assist member after completion of a last concentric movement of the selected number of repetitions of the exercise set.

* * * * *